US005201152A

United States Patent [19]

Heffner

[11] Patent Number: 5,201,152

[45] Date of Patent: Apr. 13, 1993

[54] CONTAINMENT DEVICE FOR CONTAMINATED BUILDING DEMOLITION

[75] Inventor: David C. Heffner, Youngstown, Ohio

[73] Assignee: The Babcock & Wilcox Company, New Orleans, La.

[21] Appl. No.: 922,881

[22] Filed: Jul. 31, 1992

[51] Int. Cl.[5] ..... E04B 1/343

[52] U.S. Cl. ..... 52/64; 52/79.1; 52/143; 52/DIG. 12; 135/88; 238/13

[58] Field of Search ..... 238/13; 414/137.4, 292; 52/143, 79.1, 83, 86, 63, 64, 67, DIG. 12; 135/88

[56] References Cited

U.S. PATENT DOCUMENTS

| | | | |
|---|---|---|---|
| 1,562,430 | 11/1925 | Alexander | 238/13 |
| 3,295,267 | 1/1967 | Lundell | 52/488 X |
| 3,343,321 | 9/1967 | Axelsson | 52/484 X |
| 3,534,511 | 10/1970 | Cappella | 52/63 |
| 3,563,257 | 2/1971 | Cummins | 52/63 X |
| 4,711,257 | 12/1987 | Kobayashi | 52/67 X |

FOREIGN PATENT DOCUMENTS

| | | | |
|---|---|---|---|
| 0045908 | 6/1932 | Denmark | 52/67 |
| 0742917 | 1/1956 | United Kingdom | 52/67 |
| 2026057 | 1/1980 | United Kingdom | 52/67 |

*Primary Examiner*—Carl D. Friedman

*Assistant Examiner*—Robert J. Canfield

*Attorney, Agent, or Firm*—Robert J. Edwards; D. Neil LaHaye

[57] ABSTRACT

A containment device for contaminated building demolition. A pre-engineered rigid steel frame building is supported on rail trucks movable on railroad tracks. The railroad tracks are positioned on opposite sides and along the length of the contaminated building to be demolished. The rigid steel frame building has one open end and is sized larger than the width and height of the contaminated building. This allows a portion of the contaminated building to be movably enclosed by the pre-engineered building. A flexible liner material inside the pre-engineered building, at the open end attached to the contaminated building, and at the bottom of the pre-engineered building draped to be in contact with the ground seals off the interior of the pre-engineered building to prevent the release of contaminated particles during demolishing operations. A hoist and cable are used to move the pre-engineered building on the railroad tracks. After the covered portion of the contaminated building is demolished and the area remediated, the pre-engineered building is moved on the railroad tracks to cover another portion of the contaminated building. The process is repeated until the contaminated building is completely demolished.

8 Claims, 2 Drawing Sheets

CONTAINMENT DEVICE FOR CONTAMINATED BUILDING DEMOLITION

BACKGROUND OF THE INVENTION

1. Field of the Invention

The present invention is generally related to containment systems and particularly to containment systems used in dismantling contaminated buildings.

2. General Background

During the demolition or decommissioning of buildings that are contaminated with nuclear, hazardous, or toxic material, it is necessary to prevent the spread of contaminated airborne particulate to adjacent properties and unprotected bystanders. Enclosures (containment systems) known in the art for performing such work are typically stationary, tent structures built over the area to be remediated. These existing enclosure designs are made by covering a wood or steel frame built around the existing structure with plastic sheeting or PVC coated polyester. One such known enclosure is the Sprung® Shelter System. These types of enclosures have several inherent disadvantages. The fabric or plastic coverings typically used in these enclosures are thin and relatively weak in comparison to the conventional building materials they enclose. Therefore, extreme care must be taken not to mechanically damage the covering since it provides little resistance to abrasion or cutting. Though flame retardant, the fabric or plastic coverings will burn or melt if placed in contact with an ignition or heat source. This requires extreme care when using burning or welding equipment. The fabric or plastic coverings provide little or no structural load carrying capacity. The lightweight frame of these enclosures provides the principal function of stability and structural integrity. This makes it important not to inadvertently transfer structural loads to the enclosure via falling debris. The enclosure itself must be installed as a stationary fixture firmly anchored to the ground to resist wind loading. Thus, the entire demolition project must be enclosed at one time, or the enclosure decontaminated, disassembled, and re-erected for each portion of the building demolition. It can be seen that a need exists for a containment system that is not easily breached, is resistant to wind loading, and does not require disassembly for each portion of the building demolition.

SUMMARY OF THE INVENTION

The present invention addresses the above needs in a straightforward manner. What is provided is a movable rigid containment system for contaminated building demolition. Railroad tracks are positioned on opposite sides of the contaminated building and extend along the length of the building. Rail trucks spaced apart on the tracks support a pre-engineered rigid steel frame building having one open end. This allows the rigid steel frame building to movably cover a portion of the contaminated building. A flexible material is used to seal the open end of the steel frame building with the contaminated building. The bottom of the steel frame building is sealed by attaching a flexible material and draping it on the ground or surface surrounding the building. This provides a sealed enclosure that prevents the escape of contaminated particles as the covered portion of the contaminated building is demolished. After the covered portion is demolished, the materials removed, and the area remediated, the seals are removed and the steel frame building is moved along the tracks by the use of a hoist to cover another portion of the contaminated building. The process is then repeated. The open end of the steel frame building is enclosed when the remaining portion of the contaminated building can be completely covered by the steel frame building.

BRIEF DESCRIPTION OF THE DRAWINGS

For a further understanding of the nature and objects of the present invention reference should be had to the following description, taken in conjunction with the accompanying drawings in which like parts are given like reference numerals, and wherein.

DETAILED DESCRIPTION OF THE PREFERRED EMBODIMENT

Figure 1:
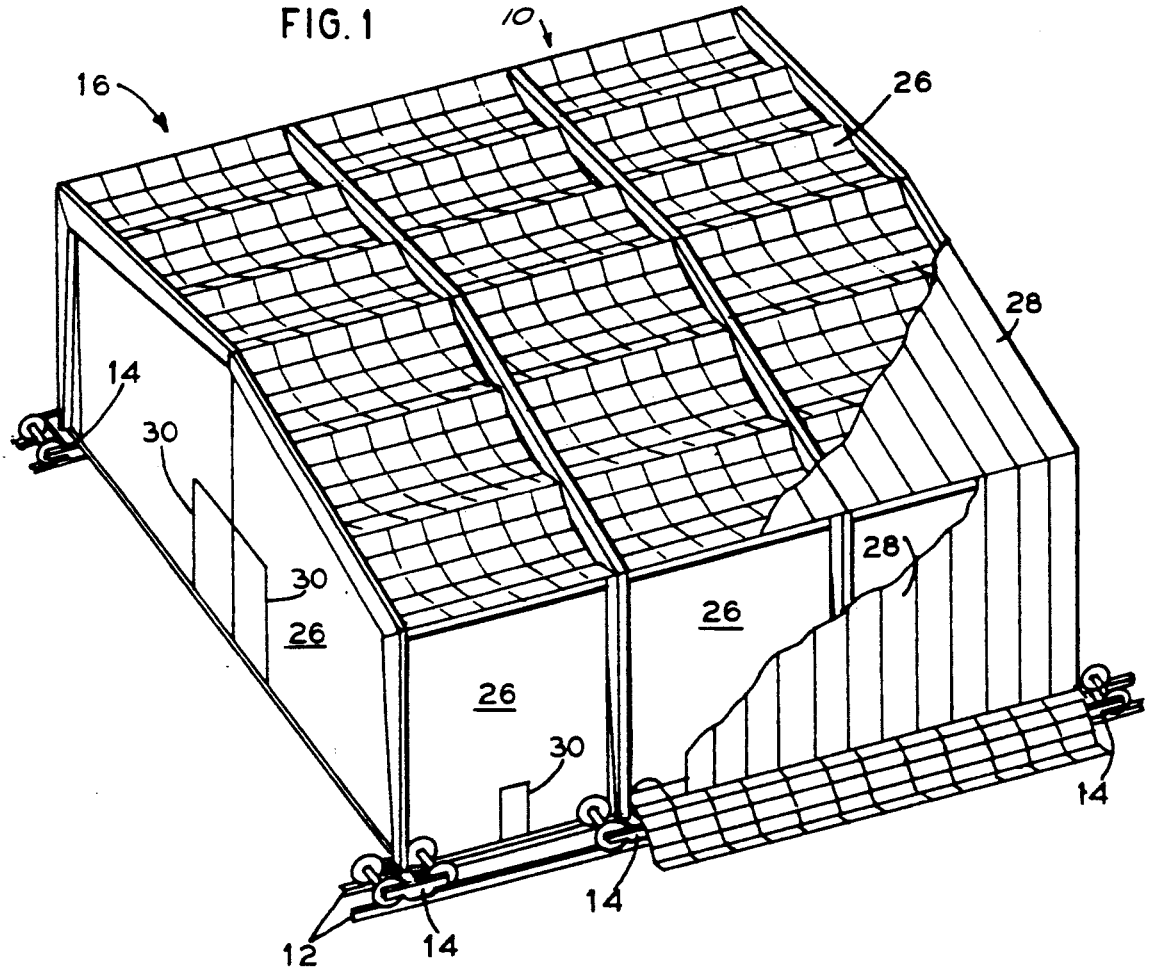
FIG. 1 is a perspective view of the invention.

Referring to the drawings, it is seen in FIG. 1 that the invention is generally indicated by the numeral 10. Containment device 10 is generally comprised of railroad tracks 12, rail trucks 14, rigid steel frame building 16, means 18 for removably sealing the open end and bottom of steel frame building 16, and means 19 for moving rail trucks 14 and rigid steel frame building 16 on railroad tracks 12.

Figure 2:
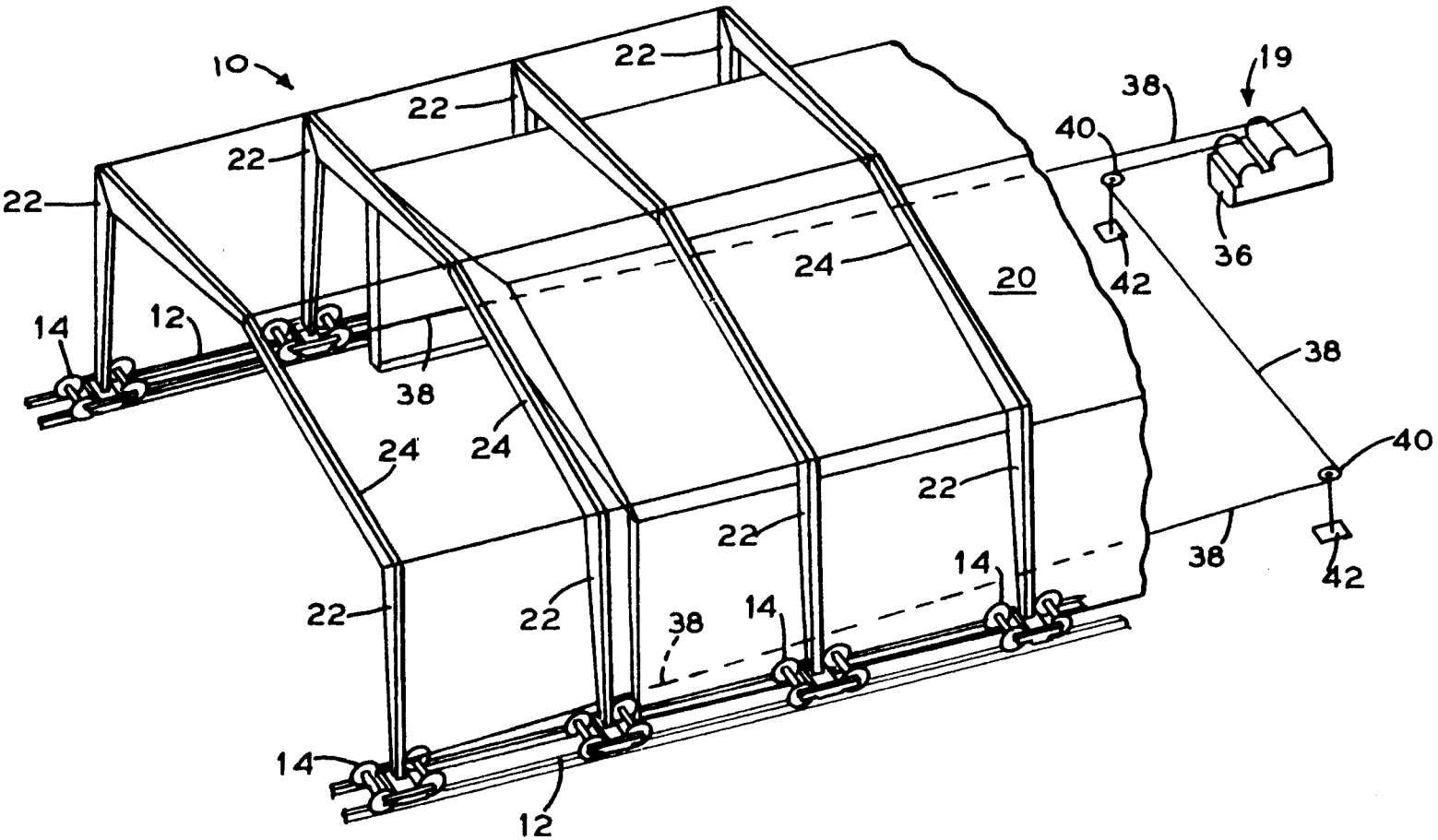
FIG. 2 illustrates the framework of the invention in position over a building to be demolished.

Railroad tracks 12 are laid down on opposite sides of the contaminated building 20, best seen in FIG. 2. Railroad tracks 12 extend along the length of contaminated building 20. Only a portion of contaminated building 20 is shown in a cutaway view. However, it should be understood that contaminated buildings to be demolished are normally much longer than rigid steel frame building 16.

Rail trucks 14, each designed to support 70 to 100 tons, are spaced apart on railroad tracks 12 on both sides of contaminated building 20. Rail trucks 14 are used to support steel frame building 16.

As best seen in FIG. 2, columns 22 are attached to rail trucks 14. Columns 22 are designed to a height such that rafters 24 readily clear the top of contaminated building 20. Construction of steel frame building 16 is carried out in the normal manner for pre-engineered buildings. The main difference, seen in FIG. 1, is the provision of a flexible inner liner material 26 that is attached to the framework of steel frame building 16. Liner material 26 thus prevents the interior of steel sheeting 28 from becoming contaminated during demolition of contaminated building 20. Liner material 26 is also more easily disposed of than exterior steel sheeting 28. In the event that falling debris does puncture or tear liner material 26, the extra strength and resilience of exterior steel sheeting 28 serves as a second barrier to the release of contaminated particles to the surrounding environment. Provisions for doors 30 in liner material 26 are made for the entry and exit of personnel and the removal of materials as contaminated building 20 is dismantled.

Figure 3:
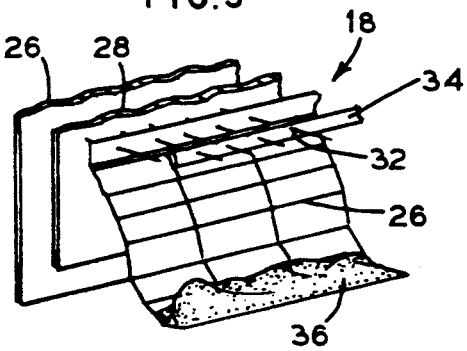
FIG. 3 illustrates the seal at the bottom of the invention.
Figure 4:
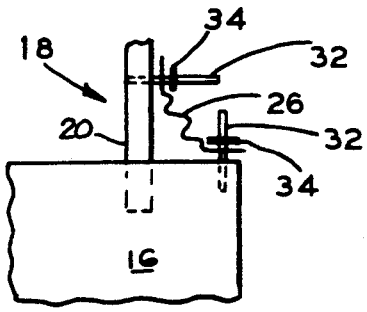
FIG. 4 illustrates the seal between the invention and the building to be demolished.

Means 18 for sealing the open end and bottom of steel frame building 16 is illustrated in FIG. 3 and 4. The open end of steel frame building 16 is sealed against the exterior of contaminated building 20 by the use of flexible material as illustrated in FIG. 4. Fasteners 32 are used to attach flexible liner material 26 to steel frame building 16 and the top and sides of contaminated building 20. Retainers 34 such as strips of metal may be used to prevent tearing of liner material 26 and provide even pressure to insure a proper seal. The bottom of steel frame building 16 is sealed against the ground or surrounding surface as illustrated in FIG. 3. Flexible material 26 is attached to steel sheeting 28 on the side of steel frame building 16 by the use of fasteners 32 and retainer 34. Flexible material 26 is draped into contact with the ground or surrounding surface. A readily removable weight or material 36 such as masonry sand is spread over the portion of flexible material 26 in contact with the ground to provide a seal at ground level.

Means 19 for moving rail trucks 14 and rigid steel frame building 16 along railroad tracks 12 (seen in FIG. 2) comprises hoist 36 and cable 38. Hoist 36 is anchored in position beyond one end of contaminated building 20. Cables 38 from hoist 36 are directed through sheaves 40 and attached to a rail truck 14 on each side of contaminated building 20. Each sheave 40 is anchored in position as indicated at numeral 42.

In operation, railroad tracks 12 are placed on opposite sides of contaminated building 20 so as to extend along the length thereof. Rail trucks 14 are spaced apart on railroad tracks 12 for receiving columns 20 of rigid steel frame building 16. During construction of steel frame building 16, a flexible liner material 26 is attached to the interior thereof to serve as a barrier to prevent contamination of steel sheeting 28 and the framework of steel frame building 16. As seen in FIG. 2 steel frame building 16 is positioned over a portion of contaminated building 20. The open end and bottom of steel frame building 16 is sealed against contaminated building 20 and the surface surrounding steel frame building 16 by the use of flexible liner material 26. The seal prevents the uncontrolled escape of contaminated particles as contaminated building 20 is dismantled or demolished. Doors 30 provide access to the interior of steel frame building 16. A HEPA (high efficiency particulate air filter) ventilation system known in the industry is used to maintain a negative pressure atmosphere equal to approximately 0.4 inches of water inside steel frame building 16. This helps to prevent the escape of particles through doors 30 when opened and through imperfect seals in liner material 26. Demolition and dismantling of the covered portion of contaminated building 20 commences once the seals are completed and the ventilation system is placed into operation. After the covered portion of contaminated building 20 is demolished and the area remediated, the seals at the bottom and open end of steel frame building are respectively lifted and detached from contaminated building 20. Hoist 36, preferably a two drum pull 5,000 pound line pull hoist, and cables 38 attached to rail trucks 14 are used to move rail trucks 14 and steel frame building 16 along railroad tracks 12 to cover another portion of contaminated building 20. The open end and bottom are sealed again and demolition and dismantling of the covered portion of contaminated building 20 are accomplished. The process is repeated until the remaining portion of contaminated building 20 is capable of being fully enclosed and covered by steel frame building 16. At this point the open end of steel frame building 16 is closed by installing liner material 26 and steel sheeting 18. The bottom is sealed as described.

This provides a containment device that is structurally sound, much more resistant to wind loading than tent-type enclosures, and not easily damaged by falling debris. The invention also provides an economic advantage over presently available enclosures. A cost estimate comparison of a commercially available enclosure to the invention for use at a known site indicated the invention to be one-fifteenth the cost of the present commercially available system.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A containment device for contaminated building demolition, comprising:

a. railroad tracks placed on a supporting surface on opposite sides and extending the length of the contaminated building;

b. a plurality of rail trucks spaced apart on said railroad tracks for movement along said tracks;

c. a rigid steel frame building having an interior, a bottom, and one open end, said rigid steel frame building being supported by said rail trucks whereby said rigid steel frame building movably covers a portion of the contaminated building; and d. means for removably sealing the open end and bottom of said rigid steel frame building.

2. The device of claim 1, wherein said means for sealing the open end of said rigid steel frame building comprises a flexible material attached to said rigid steel frame building and the contaminated building.

3. The device of claim 1, wherein said means for sealing the bottom of said rigid steel frame building comprises a flexible material attached to said rigid steel frame building and in contact with said supporting surface.

4. The device of claim 1, further comprising a flexible lining attached to the interior of said rigid steel frame building.

5. The device of claim 1, further comprising means for moving said rail trucks and said rigid steel frame building on said railroad tracks.

6. A containment device for contaminated building demolition, comprising:

a. railroad tracks placed on a supporting surface on opposite sides and extending the length of the contaminated building;

b. a plurality of rail trucks spaced apart on said railroad tracks for movement along said tracks;

c. a rigid steel frame building having an interior, a bottom, and one open end, said rigid steel frame building being supported by said rail trucks whereby said rigid steel frame building movably covers a portion of the contaminated building;

d. a flexible material attached to the open end of said rigid steel frame building and the contaminated building; and e. a flexible material attached adjacent the bottom of said rigid steel frame building and in contact with said supporting surface.

7. The device of claim 6, further comprising a flexible lining attached to the interior of said rigid steel frame building.

8. The device of claim 6, further comprising means for moving said rail trucks and said rigid steel frame building on said railroad tracks.

* * * * *